US012778193B2

(12) United States Patent
Kim et al.

(10) Patent No.: US 12,778,193 B2
(45) Date of Patent: Nov. 3, 2026

(54) AEROSOL GENERATING DEVICE

(71) Applicant: KT&G CORPORATION, Daejeon (KR)

(72) Inventors: Tae Hun Kim, Gyeonggi-do (KR); Ju Eon Park, Gyeonggi-do (KR); Sung Wook Yoon, Gyeonggi-do (KR); Hyung Jin Jung, Seoul (KR); Jung Ho Han, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 414 days.

(21) Appl. No.: 18/561,515

(22) PCT Filed: Jun. 27, 2023

(86) PCT No.: PCT/KR2023/008931
§ 371 (c)(1),
(2) Date: Nov. 16, 2023

(87) PCT Pub. No.: WO2024/005504
PCT Pub. Date: Jan. 4, 2024

(65) Prior Publication Data

US 2025/0082011 A1 Mar. 13, 2025

(30) Foreign Application Priority Data

Jun. 29, 2022 (KR) ..... 10-2022-0080023
Nov. 25, 2022 (KR) ..... 10-2022-0160789

(51) Int. Cl.
*A24F 40/30* (2020.01)
*A24F 40/10* (2020.01)
(Continued)

(52) U.S. Cl.
CPC ..... *A24F 40/30* (2020.01); *A24F 40/10* (2020.01); *A24F 40/20* (2020.01); *A24F 40/42* (2020.01); *A24F 40/485* (2020.01); *A24F 40/51* (2020.01)

(58) Field of Classification Search
CPC ..... A24F 15/01; A24F 40/48
See application file for complete search history.

(56) References Cited

U.S. PATENT DOCUMENTS 11,889,862 B2 * 2/2024 Kim ..... A24F 40/485
2020/0229501 A1 7/2020 Han et al.
(Continued)

FOREIGN PATENT DOCUMENTS

CN 110944532 A 3/2020
CN 111491528 8/2020
(Continued)

OTHER PUBLICATIONS

International Search Report of PCT/KR2023/008931 dated Sep. 25, 2023 [PCT/ISA/210].
(Continued)

*Primary Examiner* — Russell E Sparks
(74) *Attorney, Agent, or Firm* — Foley & Lardner LLP

(57) ABSTRACT

An aerosol generating device includes a case including an accommodation space to accommodate an aerosol generating article and configured to accommodate at least one electronic component, a heater arranged in the accommodation space and configured to heat the aerosol generating article accommodated in the accommodation space, a cartridge detachably coupled to the case and including a storage which stores an aerosol generating material, and a vaporizer configured to receive and heat the aerosol generating material, wherein the case includes a vent formed between the accommodation space and the cartridge, and configured to
(Continued)

be through which air heated by the heat generated from the heater or the vaporizer passes.

13 Claims, 12 Drawing Sheets

(51) Int. Cl.

| | |
|---|---|
| ***A24F 40/20*** | (2020.01) |
| ***A24F 40/42*** | (2020.01) |
| ***A24F 40/485*** | (2020.01) |
| ***A24F 40/51*** | (2020.01) |

(56) References Cited

U.S. PATENT DOCUMENTS

| | | | | |
|---|---|---|---|---|
| 2020/0329772 | A1* | 10/2020 | Kim | A24F 40/30 |
| 2020/0345066 | A1 | 11/2020 | Kim et al. | |
| 2021/0289844 | A1 | 9/2021 | Batista et al. | |
| 2021/0337872 | A1 | 11/2021 | Alston et al. | |
| 2022/0061395 | A1 | 3/2022 | Tan et al. | |
| 2023/0094786 | A1 | 3/2023 | Yoon | |
| 2023/0276849 | A1 | 9/2023 | Kim et al. | |
| 2024/0365874 | A1* | 11/2024 | Debergh | G01J 1/0437 |
| 2025/0351883 | A1* | 11/2025 | Wright | A24F 40/46 |

FOREIGN PATENT DOCUMENTS

| | | | | | |
|---|---|---|---|---|---|
| EP | 3085251 | B1 | * | 9/2019 | A24C 5/3424 |
| JP | 2021-509579 | A | | 4/2021 | |
| KR | 10-2017-0020807 | A | | 2/2017 | |
| KR | 10-2020-0057490 | A | | 5/2020 | |
| KR | 10-2138245 | B1 | | 7/2020 | |
| KR | 20200101213 | A | * | 8/2020 | G06T 5/50 |
| KR | 10-2271275 | B1 | | 6/2021 | |
| WO | 2018/130391 | A1 | | 7/2018 | |
| WO | 2019/234582 | A1 | | 12/2019 | |
| WO | WO-2021037822 | A1 | * | 3/2021 | A24F 40/40 |
| WO | 2021/152138 | A1 | | 8/2021 | |
| WO | 2022/128826 | A1 | | 6/2022 | |

OTHER PUBLICATIONS

Written Opinion of PCT/KR2023/008931 dated Sep. 25, 2023 [PCT/ISA/237].

Japanese Office Action on JP Patent Application No. 2024-502420 dated Feb. 4, 2025.

Korean Office Action on KR Patent Application No. 10-2022-0160789 dated Feb. 21, 2025.

Extended European Search Report dated Sep. 2, 2024, received in European Patent Application No. 23793217.3.

* cited by examiner

[Fig. 1]
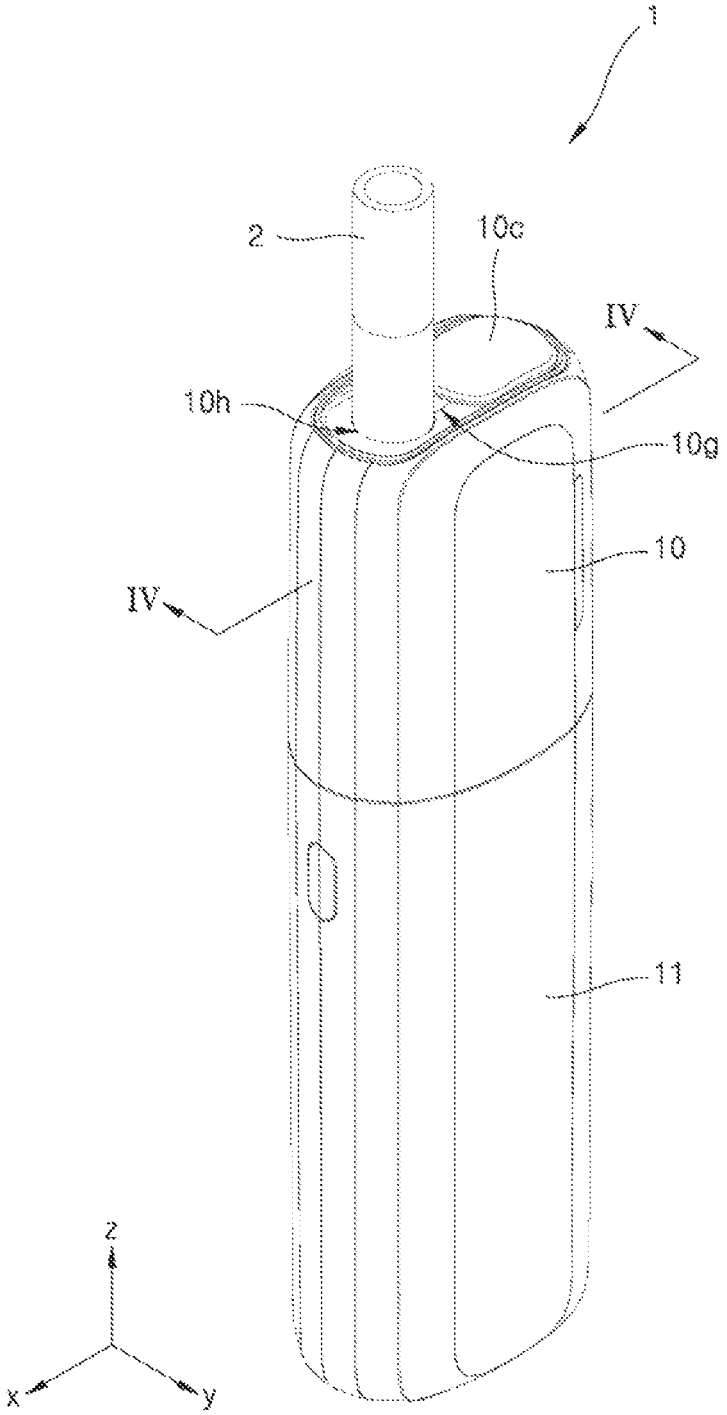

[Fig. 2]
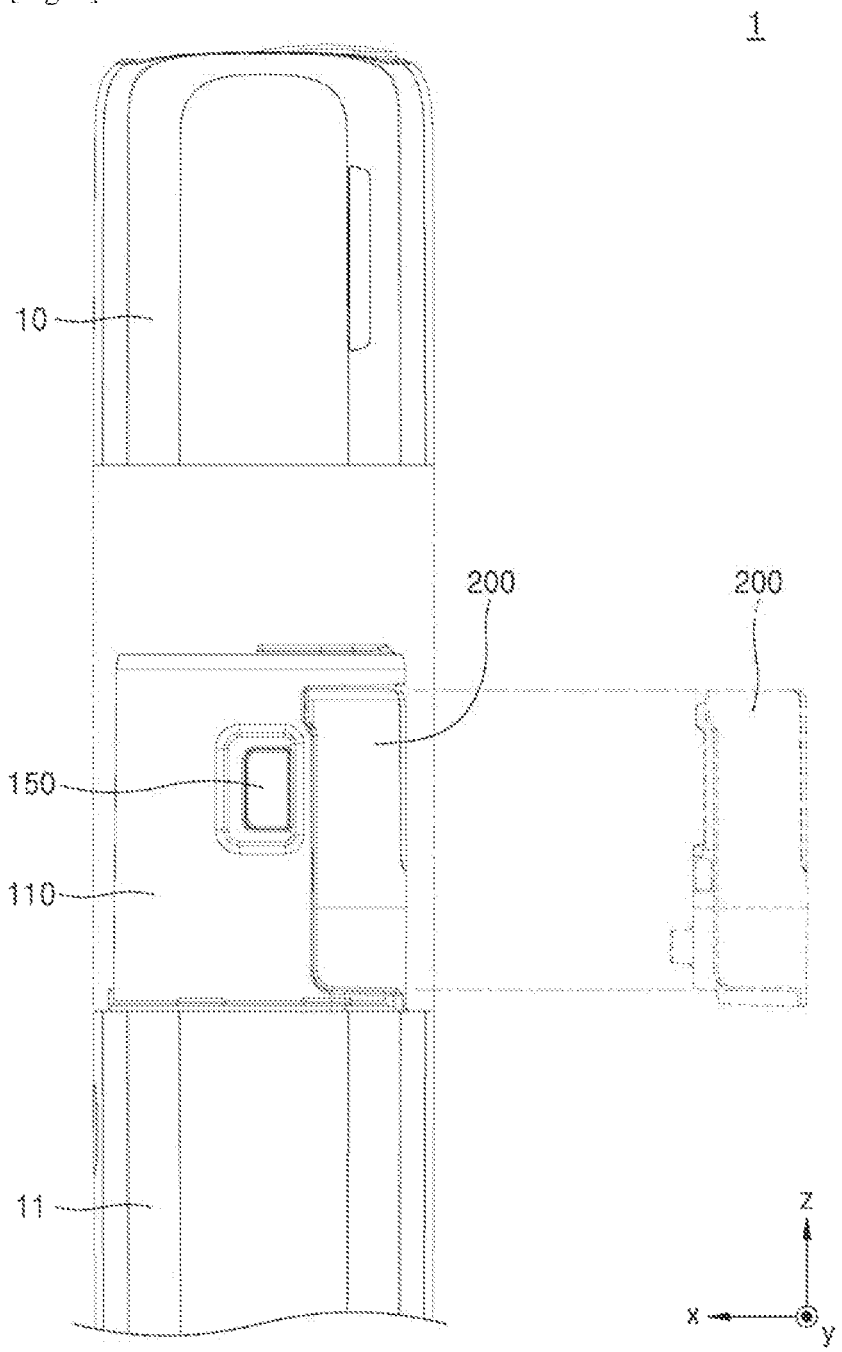

[Fig. 3]
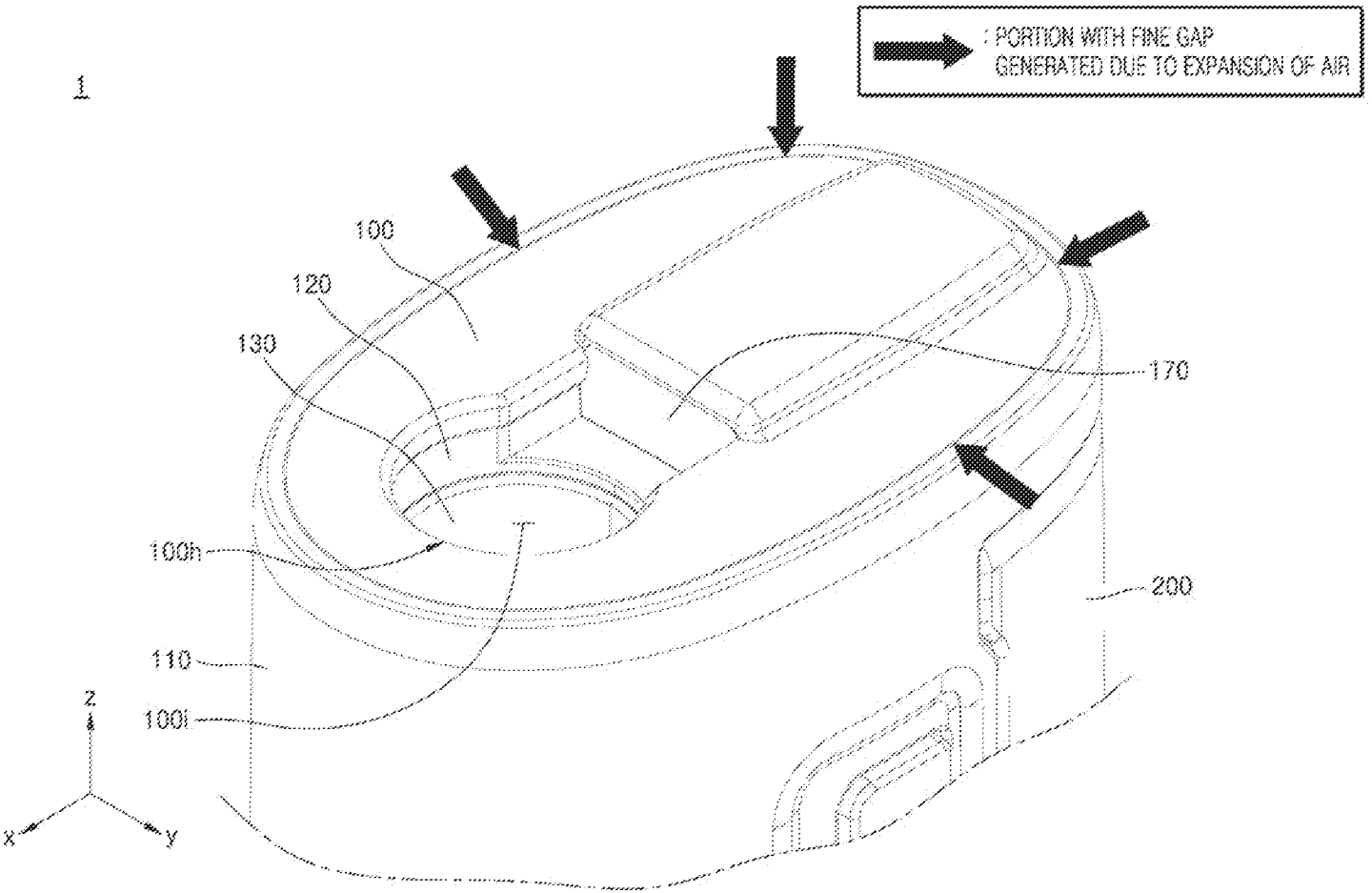

[Fig. 4]
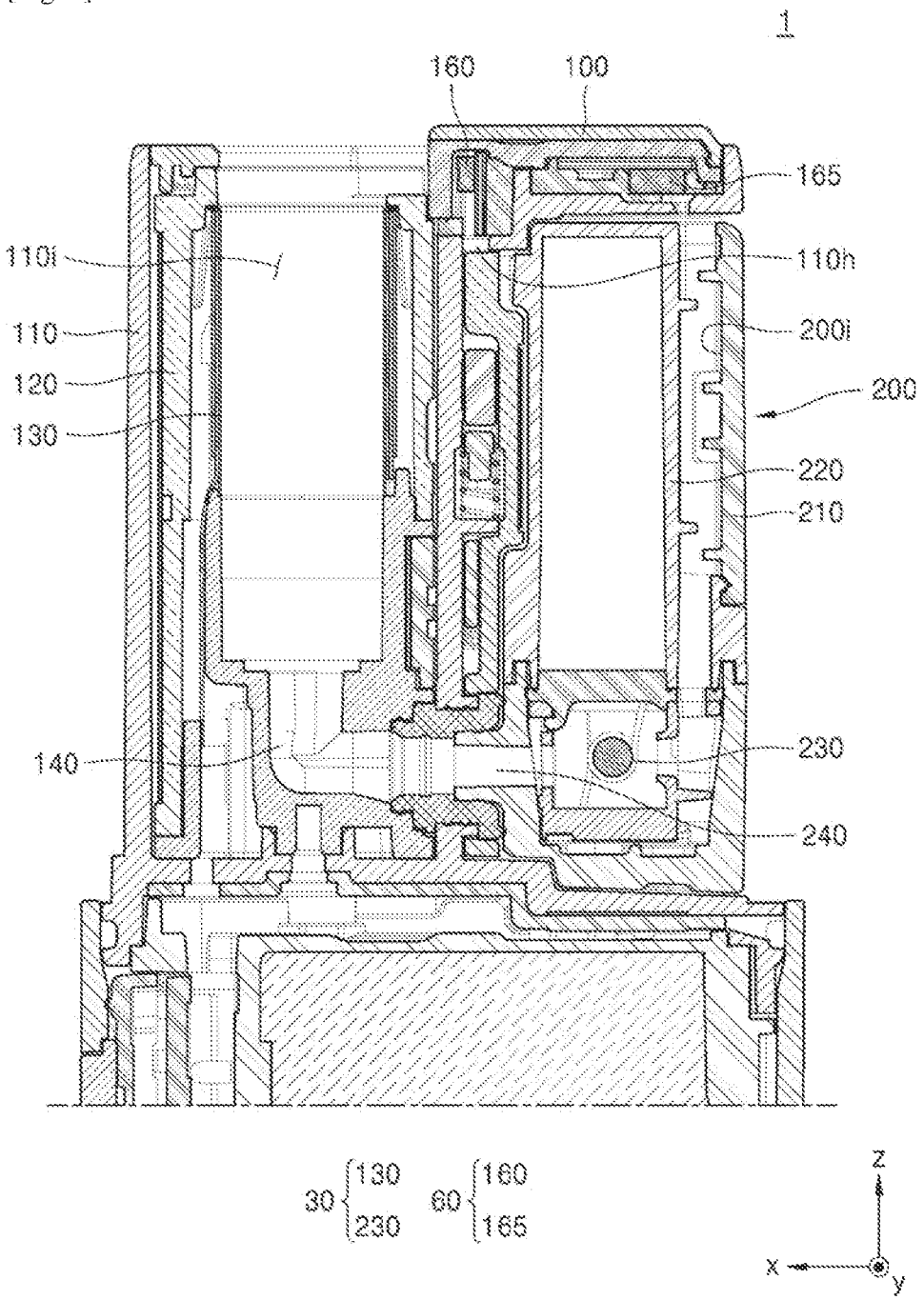

[Fig. 5]
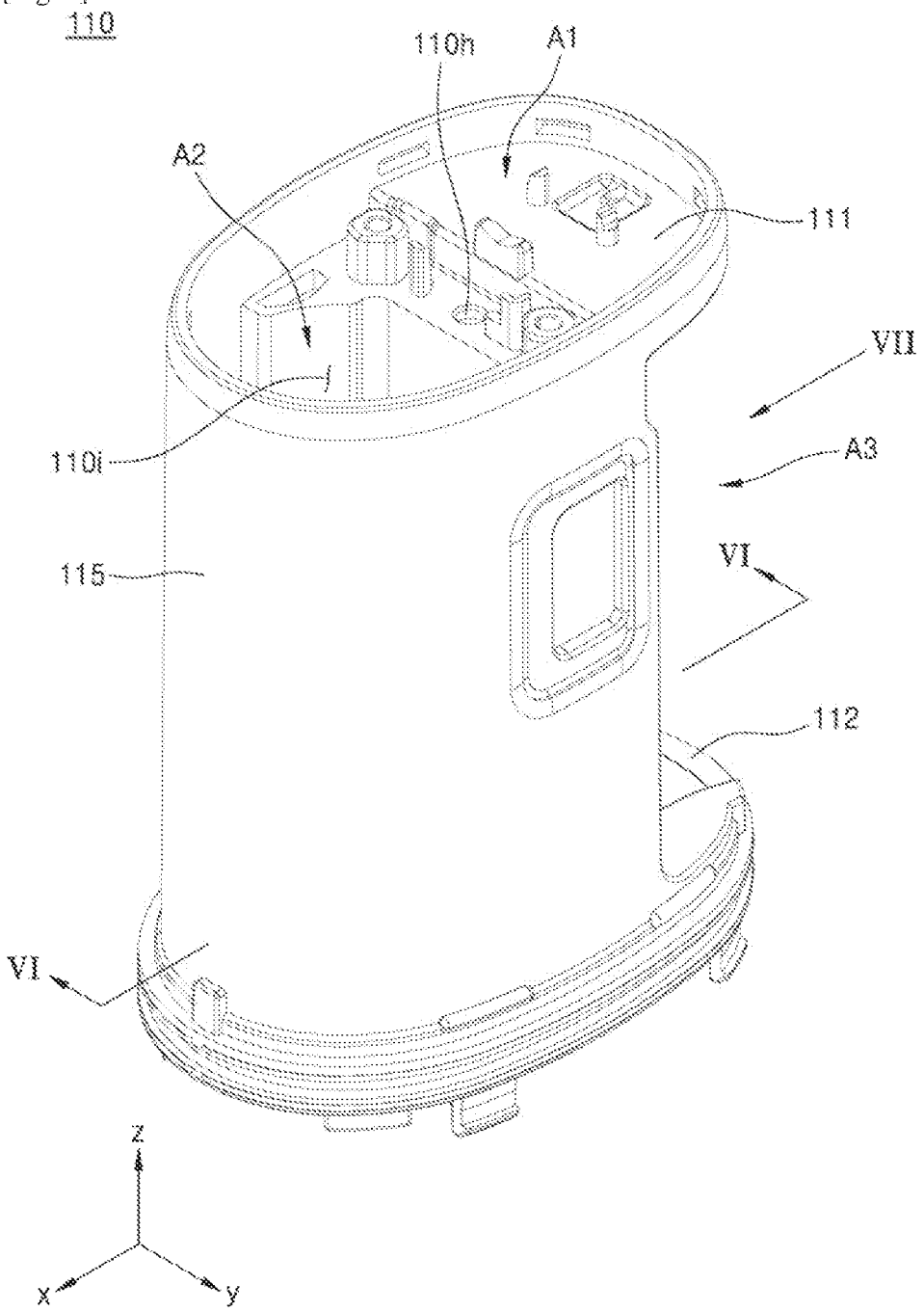

[Fig. 6]
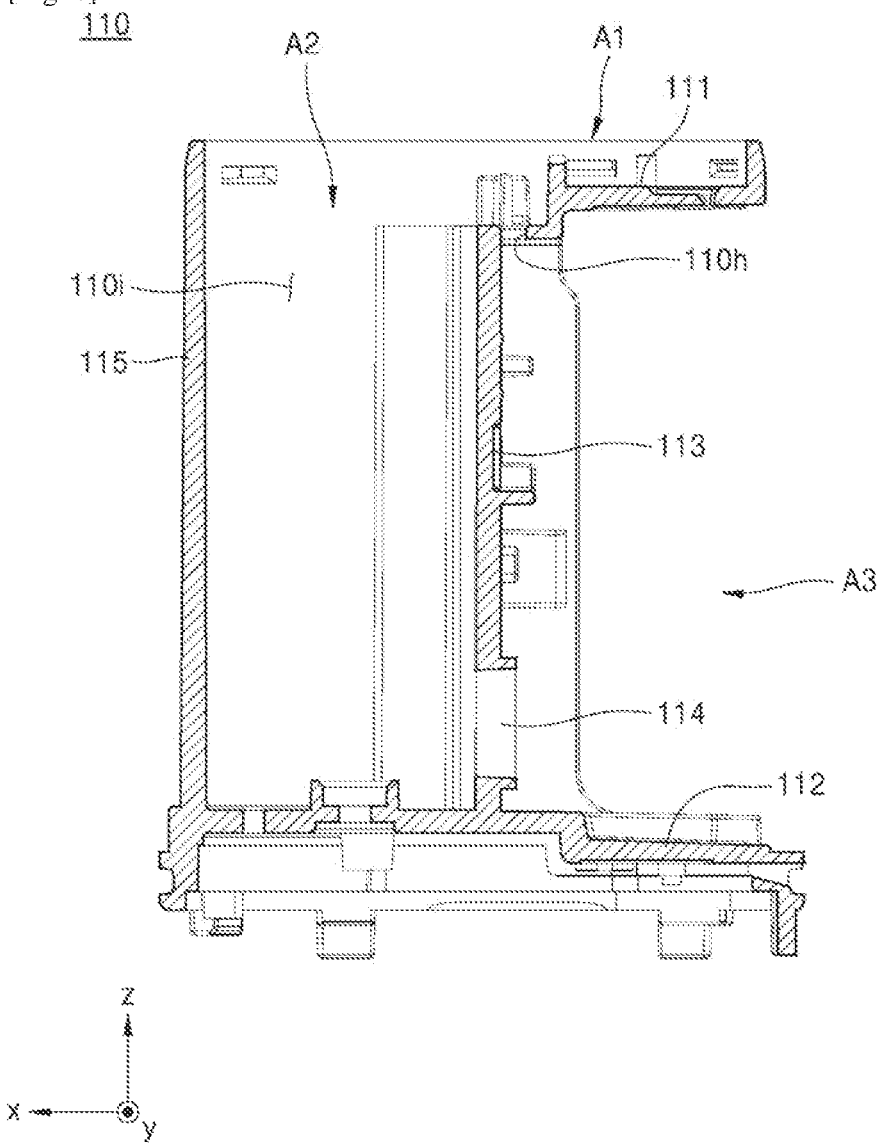

[Fig. 7]
110
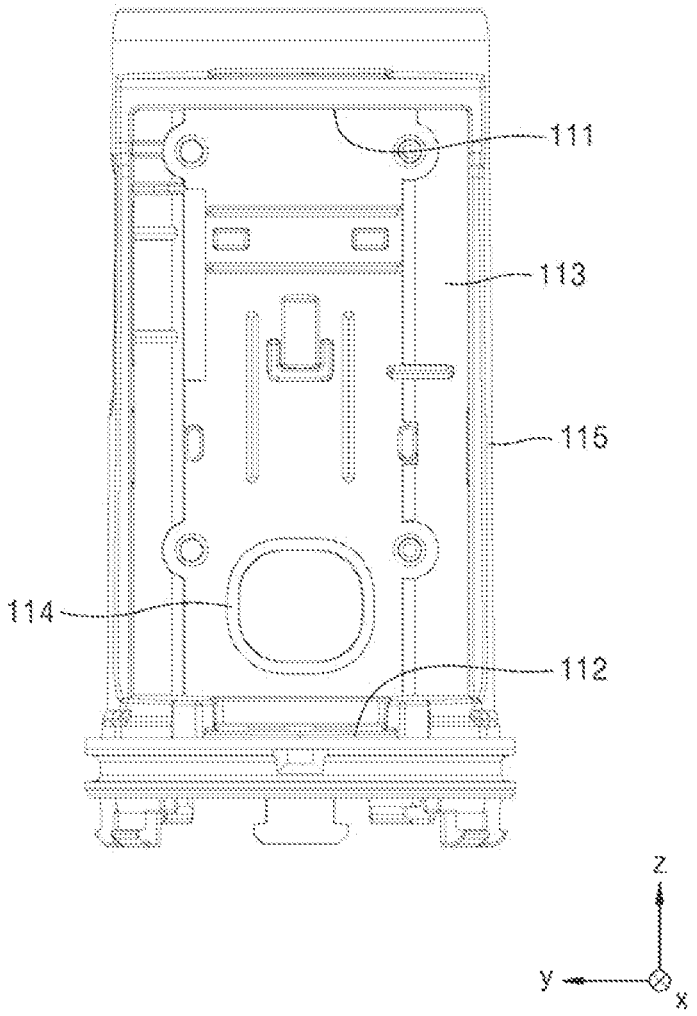

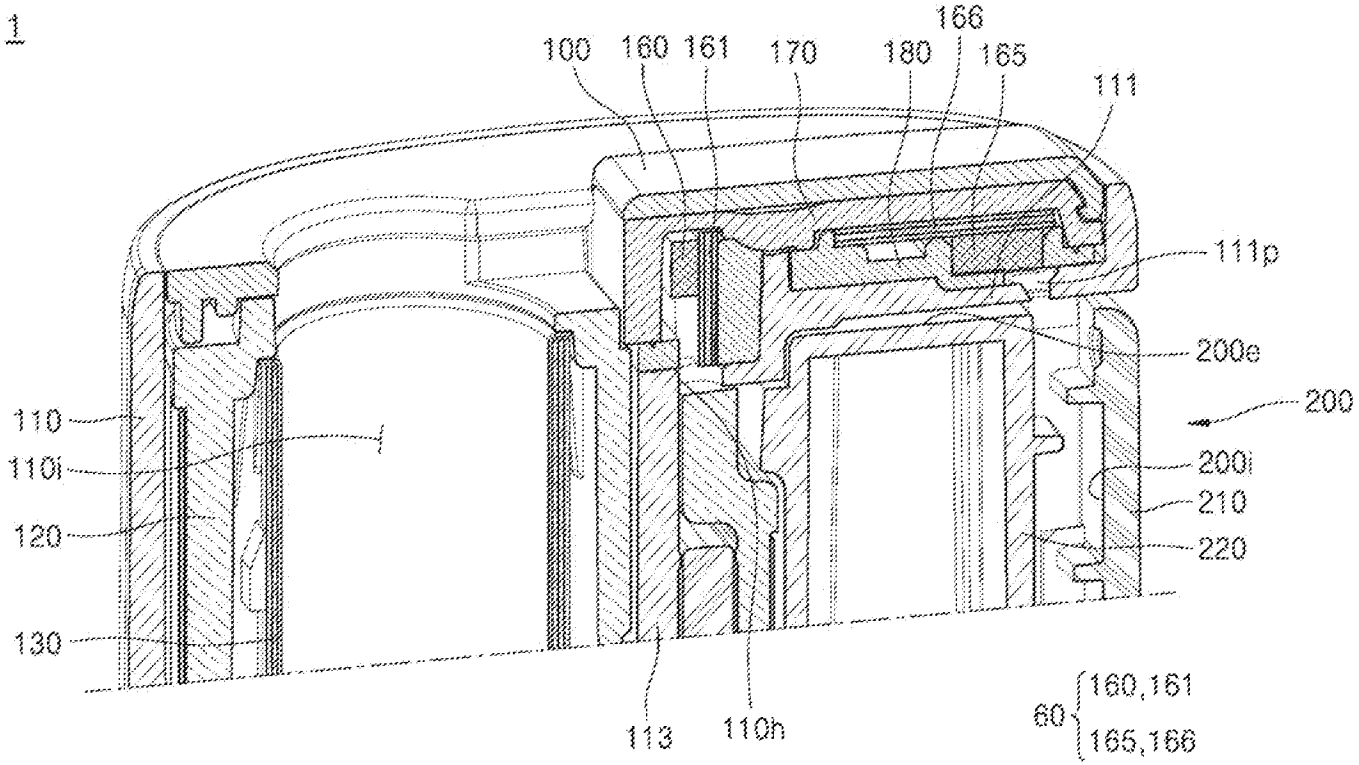
[Fig. 8]

[Fig. 9]
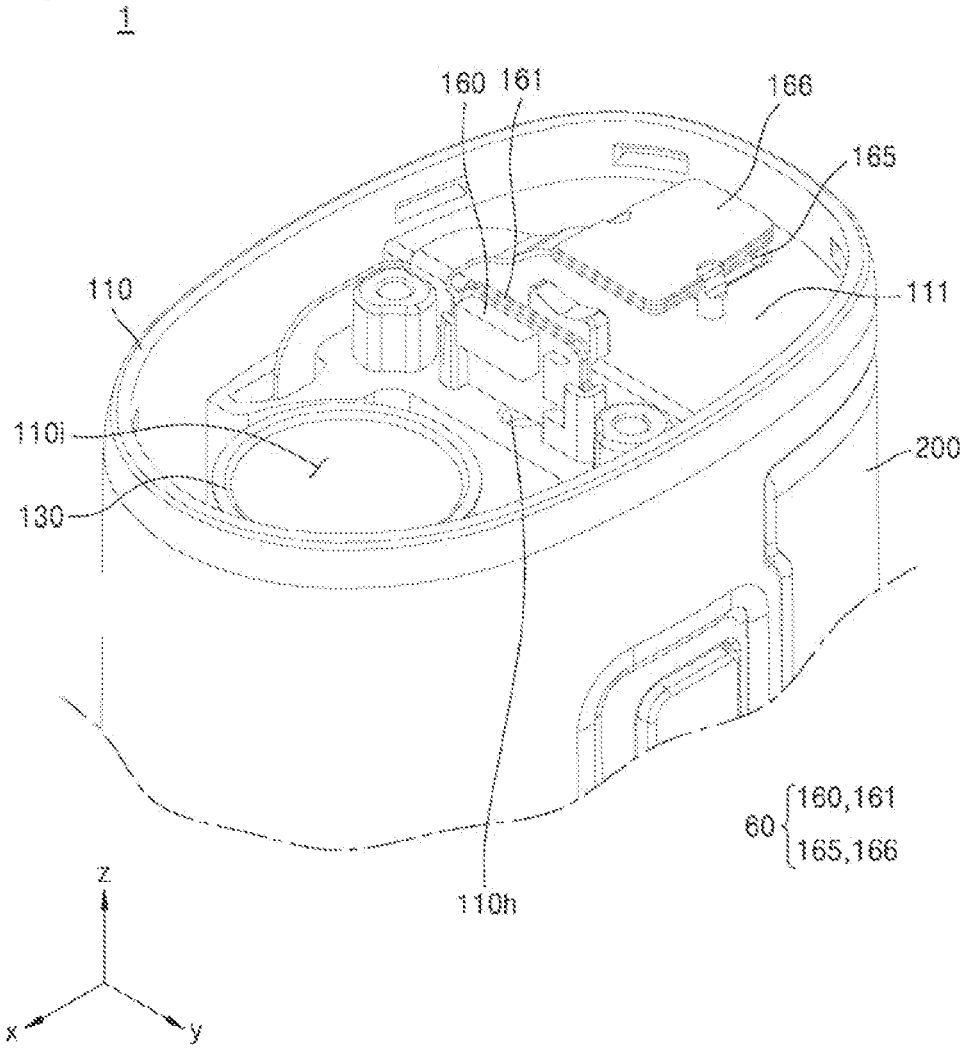

[Fig. 10]
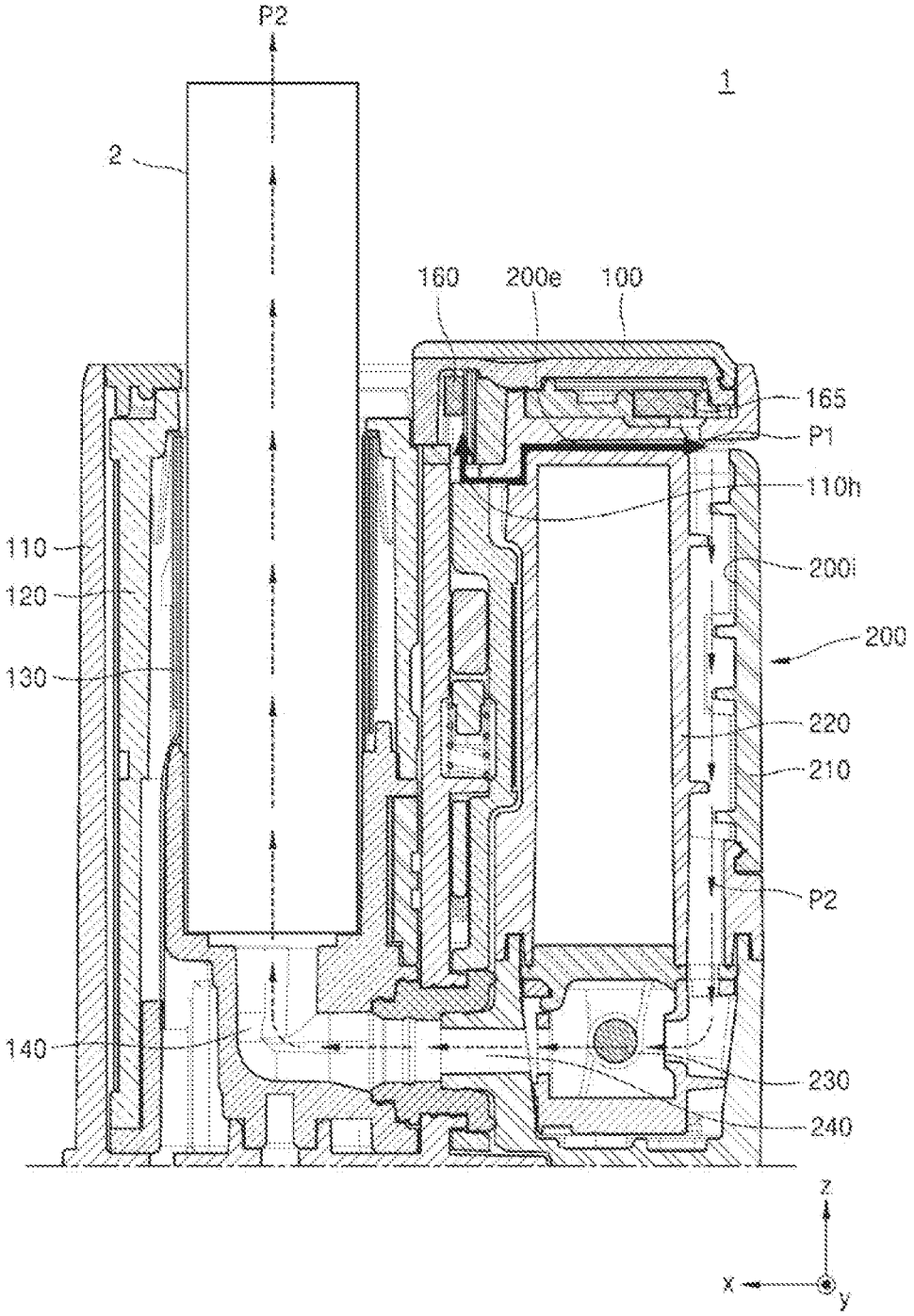

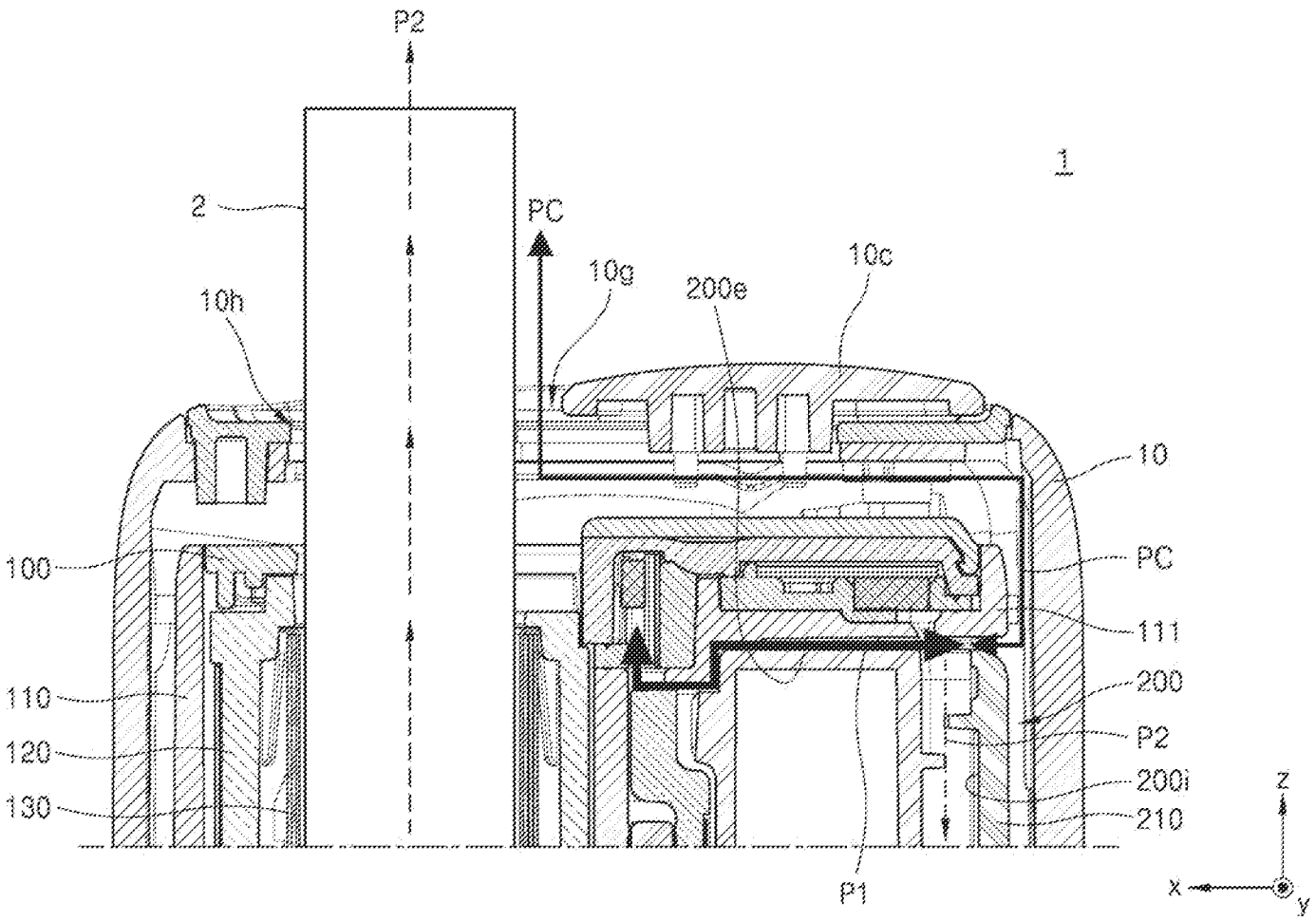
[Fig. 11]

[Fig. 12]
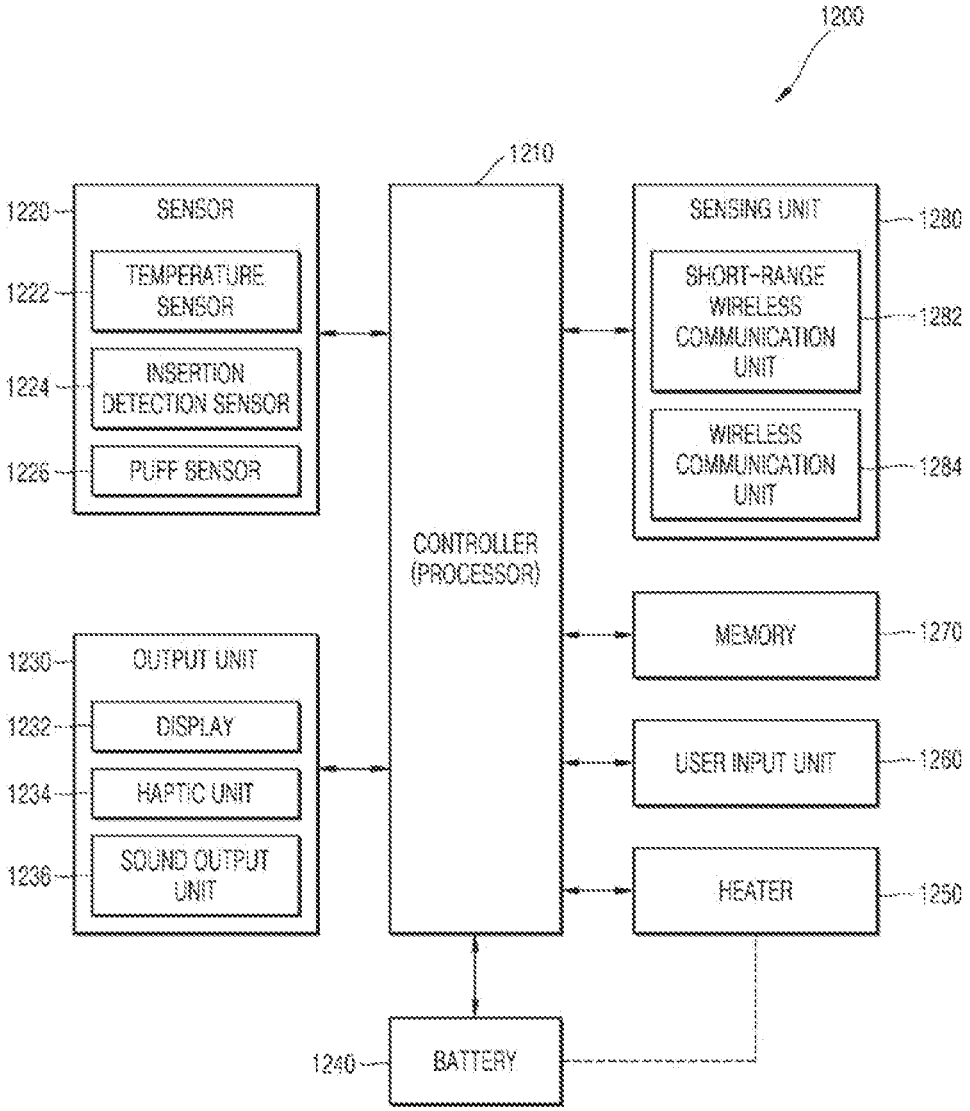

AEROSOL GENERATING DEVICE

CROSS REFERENCE TO RELATED APPLICATIONS

This application is a National Stage of International Application No. PCT/KR2023/008931 filed on Jun. 27, 2023, claiming priority based on Korean Patent Application No. 10-2022-0080023 filed on Jun. 29, 2022 and Korean Patent Application No. 10-2022-0160789 filed on Nov. 25, 2022.

TECHNICAL FIELD

One or more embodiments relate to an aerosol generating device, and more particularly, to an aerosol generating device of which components are deformed by heat to a minimum.

BACKGROUND ART

Recently, there has been an increased demand for a technology to replace a method of supplying an aerosol by burning a general cigarette. For example, research has been conducted on a method in which an aerosol is generated from an aerosol generating material in a liquid or solid state or a flavored aerosol is supplied by generating a vapor from an aerosol generating material in a liquid state and passing the generated vapor through a solid fragrance medium.

Recently, an aerosol generating device that may generate an aerosol by heating an aerosol generating article has been proposed to replace a method of supplying an aerosol by burning a cigarette. For example, the aerosol generating device may refer to a device that may generate an aerosol by heating an aerosol generating material in a liquid or solid state at a preset temperature through a heater.

When the aerosol generating device is used, it is possible to smoke without an additional accessory such as a lighter, and a user's smoking convenience may be improved by allowing a user to smoke as much as he/she wants. Thus, research on aerosol generating devices has increased in recent years.

DISCLOSURE OF INVENTION

Technical Problem

An aerosol generating device for generating an aerosol by generating heat includes a heating element that generates heat. The air inside the aerosol generating device may be heated by the heating element. Heat and pressure of the heated air may deform other components of the aerosol generating device. Therefore, a structure for effectively discharging the heated air is required.

One or more embodiments provide an aerosol generating device having an improved structure to effectively discharge the air inside the aerosol generating device.

The technical problems of the present disclosure are not limited to the above-described description, and other technical problems may be clearly understood by one of ordinary skill in the art from the embodiments to be described hereinafter.

Solution to Problem

According to one or more embodiments, an aerosol generating device includes a case including an accommodation space to accommodate an aerosol generating article and configured to accommodate at least one electronic component, a heater arranged in the accommodation space and configured to heat the aerosol generating article accommodated in the accommodation space, a cartridge detachably coupled to the case and including a storage configured to store an aerosol generating material, and a vaporizer configured to receive and heat the aerosol generating material, wherein the case includes a vent formed between the accommodation space and the cartridge, and configured to be through which air heated by the heat generated from the heater or the vaporizer passes.

Advantageous Effects of Invention

In an aerosol generating device according to one or more embodiments, components of the aerosol generating device may be prevented from being deformed by heat.

Also, in the aerosol generating device according to one or more embodiments, fogging of an optical element by heated air may be prevented.

Effects of the present disclosure are not limited to the above effects, and effects that are not mentioned could be clearly understood by one of ordinary skill in the art from the present specification and the attached drawings.

BRIEF DESCRIPTION OF DRAWINGS

FIG. 1 is a perspective view of an aerosol generating device in which an aerosol generating article is inserted, according to an embodiment.

FIG. 2 is a schematic side view of an exterior of an aerosol generating device, according to an embodiment.

FIG. 3 is a perspective view of an enlarged upper portion of an aerosol generating device from which a cover is separated, according to an embodiment.

FIG. 4 is a cross-sectional view of a portion of the aerosol generating device of FIG. 1.

FIG. 5 is a perspective view of a case of an aerosol generating device, according to an embodiment.

FIG. 6 is a cross-sectional view of the case of FIG. 5.

FIG. 7 is a side view of the case of FIG. 5.

FIG. 8 is a perspective view showing an enlarged cross-section of an upper portion of the aerosol generating device of FIG. 1.

FIG. 9 is a perspective view showing that some components of the aerosol generating device of FIG. 3 are omitted.

FIG. 10 is a cross-sectional view showing the flow of air inside an aerosol generating device in which an aerosol generating article is inserted, according to an embodiment.

FIG. 11 is a cross-sectional view showing the flow of air that moves from the inside of the aerosol generating device, in which the aerosol generating article is inserted, to the outside thereof, according to an embodiment.

FIG. 12 is a block diagram of an aerosol generating device according to an embodiment.

MODE FOR THE INVENTION

Regarding the terms in the various embodiments, the general terms which are currently and widely used are selected in consideration of functions of structural elements in the various embodiments of the present disclosure. However, meanings of the terms can be changed according to intention, a judicial precedence, the appearance of a new technology, and the like. In addition, in certain cases, terms which can be arbitrarily selected by the applicant in particular cases. In such a case, the meaning of the terms will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er". "-or", and "module" described in the specification mean units for processing at least one function and operation and can be implemented by hardware components or software components and combinations thereof.

As used herein, when an expression such as "at least any one" precedes arranged elements, it modifies all elements rather than each arranged element. For example, the expression "at least any one of a, b, and c" should be construed to include a, b, c, or a and b, a and c, b and c, or a, b, and c.

In an embodiment, an aerosol generating device may be a device that generates aerosols by electrically heating a cigarette accommodated in an interior space thereof.

The aerosol generating device may include a heater. In an embodiment, the heater may be an electro-resistive heater. For example, the heater may include an electrically conductive track, and the heater may be heated when currents flow through the electrically conductive track.

The heater may include a tube-shaped heating element, a plate-shaped heating element, a needle-shaped heating element, or a rod-shaped heating element, and may heat the inside or outside of a cigarette according to the shape of a heating element.

A cigarette may include a tobacco rod and a filter rod. The tobacco rod may be formed of sheets, strands, and tiny bits cut from a tobacco sheet. Also, the tobacco rod may be surrounded by a heat conductive material. For example, the heat conductive material may be, but is not limited to, a metal foil such as aluminum foil.

The filter rod may include a cellulose acetate filter. The filter rod may include at least one segment. For example, the filter rod may include a first segment configured to cool aerosols, and a second segment configured to filter a certain component in aerosols.

In another embodiment, the aerosol generating device may be a device that generates aerosols by using a cartridge containing an aerosol generating material.

The aerosol generating device may include a cartridge that contains an aerosol generating material, and a main body that supports the cartridge. The cartridge may be detachably coupled to the main body, but is not limited thereto. The cartridge may be integrally formed or assembled with the main body, and may also be fixed to the main body so as not to be detached from the main body by a user. The cartridge may be mounted on the main body while accommodating an aerosol generating material therein. However, the present disclosure is not limited thereto. An aerosol generating material may also be injected into the cartridge while the cartridge is coupled to the main body.

The cartridge may contain an aerosol generating material in any one of various states, such as a liquid state, a solid state, a gaseous state, a gel state, or the like. The aerosol generating material may include a liquid composition. For example, the liquid composition may be a liquid including a tobacco-containing material having a volatile tobacco flavor component, or a liquid including a non-tobacco material.

The cartridge may be operated by an electrical signal or a wireless signal transmitted from the main body to perform a function of generating aerosols by converting the phase of an aerosol generating material inside the cartridge into a gaseous phase. The aerosols may refer to a gas in which vaporized particles generated from an aerosol generating material are mixed with air.

In another embodiment, the aerosol generating device may generate aerosols by heating a liquid composition, and generated aerosols may be delivered to a user through a cigarette. That is, the aerosols generated from the liquid composition may move along an airflow passage of the aerosol generating device, and the airflow passage may be configured to allow aerosols to be delivered to a user by passing through a cigarette.

In another embodiment, the aerosol generating device may be a device that generates aerosols from an aerosol generating material by using an ultrasonic vibration method. At this time, the ultrasonic vibration method may mean a method of generating aerosols by converting an aerosol generating material into aerosols with ultrasonic vibration generated by a vibrator.

The aerosol generating device may include a vibrator, and generate a short-period vibration through the vibrator to convert an aerosol generating material into aerosols. The vibration generated by the vibrator may be ultrasonic vibration, and the frequency band of the ultrasonic vibration may be in a frequency band of about 100 kHz to about 3.5 MHz, but is not limited thereto.

The aerosol generating device may further include a wick that absorbs an aerosol generating material. For example, the wick may be arranged to surround at least one area of the vibrator, or may be arranged to contact at least one area of the vibrator.

As a voltage (for example, an alternating voltage) is applied to the vibrator, heat and/or ultrasonic vibrations may be generated from the vibrator, and the heat and/or ultrasonic vibrations generated from the vibrator may be transmitted to the aerosol generating material absorbed in the wick. The aerosol generating material absorbed in the wick may be converted into a gaseous phase by heat and/or ultrasonic vibrations transmitted from the vibrator, and as a result, aerosols may be generated.

For example, the viscosity of the aerosol generating material absorbed in the wick may be lowered by the heat generated by the vibrator, and as the aerosol generating material having a lowered viscosity is granulated by the ultrasonic vibrations generated from the vibrator, aerosols may be generated, but is not limited thereto.

In another embodiment, the aerosol generating device is a device that generates aerosols by heating an aerosol generating article accommodated in the aerosol generating device in an induction heating method.

The aerosol generating device may include a susceptor and a coil. In an embodiment, the coil may apply a magnetic field to the susceptor. As power is supplied to the coil from the aerosol generating device, a magnetic field may be formed inside the coil. In an embodiment, the suspector may be a magnetic body that generates heat by an external magnetic field. As the suspector is positioned inside the coil and a magnetic field is applied to the suspector, the suspector generates heat to heat an aerosol generating article. In addition, optionally, the suspector may be positioned within the aerosol generating article.

In another embodiment, the aerosol generating device may further include a cradle.

The aerosol generating device may configure a system together with a separate cradle. For example, the cradle may charge a battery of the aerosol generating device. Alternatively, the heater may be heated when the cradle and the aerosol generating device are coupled to each other.

Hereinafter, the present disclosure will now be described more fully with reference to the accompanying drawings, in which exemplary embodiments of the present disclosure are shown such that one of ordinary skill in the art may easily work the present disclosure. The present disclosure may be implemented in a form that can be implemented in the aerosol generating devices of the various embodiments described above or may be implemented in various different forms, and is not limited to the embodiments described herein.

Hereinafter, embodiments of the present disclosure will be described in detail with reference to the drawings.

FIG. 1 is a perspective view of an aerosol generating device in which an aerosol generating article is inserted, according to an embodiment.

Referring to FIG. 1, an aerosol generating device 1 according to an embodiment may include a cover 10 and a main body 11.

As the cover 10 is coupled to an end portion of the main body 11, the main body 11 and the cover 10 may form an exterior of the aerosol generating device 1.

The cover 10 may include an opening 10*h* through which an aerosol generating article 2 may be inserted into an upper surface of the cover 10.

The cover 10 may include a stopper 10*c* that may open and close the opening 10*h*. The stopper 10*c* may be arranged on the upper surface of the cover 10 and slide to open and close the opening 10*h*.

The cover 10 may include a sliding groove 10*g* in the upper surface of the cover 10, the sliding groove 10*g* extending in a direction in which the stopper 10*c* slides. The sliding groove 10*g* may be open so that the outside of the cover 10 may be in fluid communication with the inside thereof.

When the stopper 10*c* is moved along the sliding groove 10*g* located in the upper surface of the cover 10, the opening 10*h* may be externally exposed. Therefore, a user may insert the aerosol generating article 2 into the opening 10*h*. Here, the aerosol generating article 2 may be an example of a solid aerosol generating source used in the aerosol generating device 1.

The main body 11 may form a portion of the exterior of the aerosol generating device 1 and accommodate and protect components thereof. For example, in the main body 11, a battery (not shown), a processor (not shown), and/or a heater (not shown) may be accommodated, but one or more embodiments are not limited thereto. Also, the main body 11 may accommodate the aerosol generating article 2 inserted through the opening.

The main body 11 and the cover 10 may each include a plastic material, through which heat is not transferred well, or a metal material coated with a heat-shielding material. The main body 11 and the cover 10 may be manufactured according to, for example, an injection molding method, a three-dimensional (3D) printing method, or a method whereby small components manufactured according to injection molding are assembled.

A maintaining device (not shown) may be installed between the main body 11 and the cover 10, the maintaining device for maintaining a state in which the main body 11 is coupled to the cover 10. The maintaining device may include, for example, protrusions and grooves. As the protrusions remain coupled to the grooves, the coupling of the cover 10 to the main body 11 may be maintained. In an embodiment, the protrusions may be separated from the grooves by a user manipulating an operation button.

Also, the maintaining device may include, for example, a magnet and a metal material attached to the magnet. When the maintaining device includes a magnet, the magnet may be installed on any one of the main body 11 and the cover 10, and a metal material attached to the magnet may be installed on the other thereof. Alternatively, magnets may be installed on both the main body 11 and the cover 10.

The components of the aerosol generating device 1 are not limited to the above embodiment, and an aerosol generating device 1 according to another embodiment may not include the cover 10.

FIG. 2 is an exploded side view schematically showing the exterior of the aerosol generating device, according to an embodiment.

Referring to FIG. 2, the aerosol generating device 1 may include the cover 10, the main body 11, a case 110, a button 150, and a cartridge 200.

The cover 10 may be decoupled from the main body 11 and separated therefrom. For example, the cover 10 may be separated from the main body 11 in a +z direction. When the cover 10 is separated from the main body 11, the case 110, the button 150, and the cartridge 200, which are arranged on an upper portion of the main body 11, may be externally exposed.

The case 110 may accommodate and protect the components arranged on the upper portion of the main body 11. According to an internal structure of the case 110, the components may be respectively accommodated in different directions and arranged in different sections in the case 110.

At least a portion of the button 150 may be exposed to the outside of the case 110, and according to a user input, the button 150 may release coupling between the case 110 and the cartridge 200. For example, when a user input is applied to the button 150, the cartridge 200 may be separated from the cartridge 110.

The cartridge 200 may store and heat an aerosol generating material to generate an aerosol. Also, the cartridge 200 may be detachably coupled to one side of the case 100.

According to an embodiment, the cartridge 200 may be coupled to the main body 11 including the processor (not shown) and/or the battery (not shown). The cartridge 200 may be considered a component of the aerosol generating device. For example, a heater (not shown) included in the cartridge 200 may be electrically connected to the main body 11 and receive power from the battery, and power supply may be controlled by the processor.

That is, as power is supplied to the heating element and controlled in the aerosol generating device including the cartridge 200, an aerosol may be generated from the aerosol generating material stored in the cartridge 200 in the form of a liquid or gel.

According to another embodiment, the cartridge 200 may be coupled to the main body 11 that further includes an accommodation space (not shown), in which the aerosol generating article is accommodated, and a heater (not shown) for heating the aerosol generating article accommodated in the accommodation space.

That is, the aerosol generating device including the cartridge 200 may generate an aerosol by heating not only the aerosol generating material stored in the cartridge 200 but also the inserted aerosol generating article. Accordingly, a hybrid aerosol generating device may be realized.

FIG. 2 shows that the cartridge 200 is coupled to the main body 11 from a side surface thereof, but the coupling method of the cartridge 200 and the main body 11 is not limited thereto. For example, like the cover 10, the cartridge 200 may be coupled to the main body 11 by moving in the −z direction from above the main body 11.

Hereinafter, for convenience of explanation, it will be assumed that the cartridge 200 is coupled to the side surface of the main body 11.

FIG. 3 is a perspective view showing an enlarged upper portion of the aerosol generating device, from which a cover is separated, according to an embodiment.

Referring to FIG. 3, the aerosol generating device 1 may include a cover 100, the case 110, a housing 120, a heater 130, a sealing portion 170, and the cartridge 200.

The cover 100 may be arranged on an upper portion of the case 110 and may cover components thereon.

The cover 100 may be detachably coupled to the upper portion of the case 110. The cover 100 may include a plurality of protrusions thereunder such that the cover 100 may be fixed to the case 110 while being coupled thereto. The case 110 may include a plurality of grooves in an upper end portion of a side wall. As the protrusions remain inserted into the grooves, the coupling of the cover 100 to the case 110 may be maintained.

The cover 100 may include an insertion hole **100*h* that is arranged coaxially with the opening (e.g., the opening 10*h* of FIG. 1) of the cover (the cover 10 of FIG. 1) and allows for insertion of the aerosol generating article into the case 110. The aerosol generating article may be accommodated in an accommodation space 110*i* by passing through the opening and the insertion hole 100*h***.

FIG. 3 shows that the cover 100 contacts and covers a portion of the housing 120 and an upper surface of the sealing portion 170, but components that may be covered by the cover 100 are not limited thereto.

The case 110 may include the accommodation space **110*i* for accommodating an aerosol generating article (not shown). In this case, the accommodation space 110*i* may be not only a space surrounded by the case 110 but a space surrounded by the housing 120 accommodated in the case 110**.

The housing 120 may include the accommodation space **110*i* arranged inside the case 110 and accommodating therein the aerosol generating article. Also, the housing 120 may accommodate therein the heater 130 and other components. An inner wall of the housing 120 may support the heater 130** and other components not to move.

The heater 130 may be arranged inside the housing 120 and generate an aerosol by heating the aerosol generating article accommodated in the accommodation space **110*i*. The heater 130** may generate heat by power supplied from the battery (not shown).

FIG. 3 shows that the heater 130 is arranged outside the aerosol generating article accommodated in the accommodation space **110*i*, but one or more embodiments are not limited thereto. For example, the heater 130** may include a tube-type heating element, a plate-type heating element, a needle-type heating element, or a rod-type heating element, and may heat the inside or outside of the aerosol generating article, according to the shape of the heating element.

The sealing portion 170 may be arranged between the cover 100 and the case 110, and cover at least a portion of the case 110 and the components that are arranged on the upper portion of the case 110. Therefore, the components arranged on the upper portion of the case 110 may be double-covered by the sealing portion 170 and the cover 100.

FIG. 3 shows that the sealing portion 170 covers a lower space of the cover 100 in an x-axis direction, but a direction in which the cover 100 covers and hides the components is not limited thereto.

A space where electronic components are arranged needs to be sealed to prevent the aerosol and a liquid existing inside and outside the aerosol generating device 1 from affecting the components arranged on the upper portion of the case 110, in particular, the electronic components (not shown).

In this case, the electronic component may be a component electrically driven and may include a passive element such as a resistor or a condenser, an active element such as a semiconductor, a connection component such as a connector, a switch, an electric wire, or a circuit board, or the like.

The sealing portion 170 may form a closed space together with other components that cover the above electronic components and contact the sealing portion 170. The electronic components may be arranged in the closed space.

In addition, the cover 100 may be coupled to the case 110, cover the sealing portion 170, and apply pressure in a-z direction that is a direction in which the sealing portion 170 faces a lower surface of the cover 100. Thus, the sealing effect of the sealing portion 170 may be improved.

Air exists inside the aerosol generating device 1 and in the above-described closed space after the assembly of the components of the aerosol generating device 1 is completed.

The air, which exists in the closed space where the electronic components of the aerosol generating device 1 are arranged, may fail to be externally discharged because of a dense or sealed structure of the components and may be entrapped inside.

In this case, heat, which is repeatedly generated by the heater 130 while the aerosol generating device 1 is used, may heat the air in the closed space.

Heat generated by not only the heater 130 but also a vaporizer (not shown) for heating the aerosol generating material may affect the heating of the air in the closed space. Hereinafter, the term "heating element" may collectively refer to the heater 130 and the vaporizer for generating an aerosol by generating heat.'

When the air in the closed space in which the electronic components of the aerosol generating device 1 are arranged is heated by heat of the heating element, the air expanding due to the heating may push the components (e.g., the electronic components) towards the outside of the aerosol generating device 1.

The closed space may expand due to the heat and pressure of the heated air, and thus the components may be deformed. Also, in portions in which the density or a sealing degree of the components is low, gaps may be instantaneously generated because of the air expansion. An aerosol outside the aerosol generating device may be introduced to the inside of the aerosol generating device 1 through the gaps.

Droplets may be generated as the aerosol introduced to the inside of the aerosol generating device 1 is cooled, and the generated droplets may be accumulated inside the aerosol generating device 1. When such cooling and accumulation occur repeatedly, the aerosol introduced to the inside of the aerosol generating device 1 and the accumulated droplets may affect the electronic components arranged inside the aerosol generating device 1.

In the case of an optical element (e.g., a lens) included in an optical sensor, for example, an inner side of the optical sensor may fog, and the fogging may degrade the function of the optical sensor.

There is a need to discharge the heated air to the outside to prevent the deformation of the components by the heated air' which causes the above phenomena, that is, 'the negative influence of the heated air.' To discharge the air heated by the heating element to the outside, the case 110 may include a vent (not shown) through which the heated air passes.

Hereinafter, components arranged on an upper portion of a main body are described in detail with reference to FIG. 4.

FIG. 4 is a cross-sectional view of a portion of the aerosol generating device of FIG. 1, taken along in the IV-IV direction.

Referring to FIG. 4, the aerosol generating device 1 may include the cover 100, the case 110, the housing 120, the heater 130, a transmission passage 140, and the cartridge 200. The cartridge 200 may include a side plate 210, a storage 220, a vaporizer 230, and an outlet 240.

At least one of the components of the aerosol generating device 1 according to an embodiment may be the same as or similar to at least one of the components of the aerosol generating device 1 of FIG. 3, and repeated descriptions are omitted hereinafter.

According to an internal structure, the components may be respectively accommodated in different directions and located in different sections of the case 110.

The case 110 may be divided into multiple sections. The sections of the case 110 may include a section in which electronic components 60 are accommodated, a section in which the aerosol generating article is accommodated and the housing 120, the heater 130, the transmission passage 140, and the like are arranged, a section in which the cartridge 200 is arranged, and the like. Each section is described below with reference to FIGS. 5 to 7.

The case 110 may include a vent **110*h* for externally discharging the air heated by the heat generated by a heating element 30**.

The vent **110*h* may be arranged at a proper location of the case 110, where 'the negative influence of the heated air' is great. For example, the vent 110*h* may be arranged at a region where the electronic components 60 concentrate inside the aerosol generating device 1**.

Also, the vent **110*h* may be arranged at a proper location such that the heated air is not accumulated inside the aerosol generating device 1 and smoothly moves through the vent 110*h*. Also, the vent 110*h* may be arranged at a proper location where the aerosol outside the aerosol generating device 1 is prevented from flowing into the aerosol generating device 1**.

When the above features are considered, the vent **110*h* may be arranged inside the aerosol generating device 1, wherein the inside is covered by other components. The vent 110*h* may not be externally exposed even when the cover (e.g., the cover 10 of FIG. 2) is separated from the aerosol generating device 1**.

The transmission passage 140 may be accommodated inside the housing 120, receive the aerosol generated from the cartridge 200, and transmit the aerosol to the accommodation space **110*i*** where the aerosol generating article (not shown) is accommodated.

The aerosol transmitted to the accommodation space **110*i* may pass through the aerosol generating article inserted into the accommodation space 110*i*** and be delivered to the user.

The cartridge 200 may include an air inflow passage **200*i*** through which external air is introduced and may heat the aerosol generating material, thereby generating an aerosol.

The side plate 210 may be arranged adjacent to the storage 220 of the cartridge 200, and the air inflow passage **200*i* may be arranged between the side plate 210 and a surface of the storage 220. The air inflow passage 200*i* may deliver air outside the cartridge 200 to the vaporizer 230**.

The side plate 210 and the surface of the storage 220 may each include a plurality of protrusions protruding towards the air inflow passage **200*i*. The protrusions may prevent the droplets generated in the vaporizer 230 from being discharged to the outside through the air inflow passage 200*i***.

The storage 220 may store the aerosol generating material. The aerosol generating material may be a liquid including a tobacco-containing material having a volatile tobacco flavor component, or a liquid including a non-tobacco material.

The vaporizer 230 may receive the aerosol generating material from the storage 230 and heat the aerosol generating material, and thus, the aerosol may be generated.

In detail, the vaporizer 230 may include a liquid delivery element for absorbing the aerosol generating material in the storage 220 and delivering the same to a heater, and the heater for heating the aerosol generating material delivered by the liquid delivery element.

The vaporizer 230 may be connected to the air inflow passage **200*i* and receive air therefrom. In this case, a gas generated from the aerosol generating material heated by the vaporizer 230** may be mixed with the air, and thus, the aerosol may be generated.

An outlet 240 may discharge the aerosol generated in the vaporizer 230 to the outside of the cartridge 200. The outlet 240 may be connected to the transmission passage 140. The aerosol generated inside the cartridge 200 may be transmitted to the aerosol generating article, which is accommodated in the accommodation space **110*i*, through the transmission passage 140**.

A direction in which the outlet 240 is directed may be a direction crossing a direction in which the aerosol generating article is inserted. The transmission passage 140 may be bent or curved in the shape of the letter 'L' and extends in the direction, in which the outlet 240 is directed, and the direction in which the aerosol generating article is inserted. However, one or more embodiments are not limited to the direction of the outlet and the shape of the transmission passage.

A portion in which the outlet 240 is connected to the transmission passage 140 may be sealed. As the outlet 240 and the transmission passage 140 may be connected airtight to each other, the aerosol may be prevented from leaking out of the transmission passage 140 while the aerosol is delivered from the outlet 240 to the transmission passage 140.

Hereinafter, the structure of the case 110 and the arrangement of the vent **110*h* are described in detail with reference to FIGS. 5 to 7**.

FIGS. 5 to 7 are diagrams for explaining a case and a vent of an aerosol generating device, according to an embodiment.

FIG. 5 is a perspective view of the case of the aerosol generating device, according to an embodiment. FIG. 6 is a cross-sectional view of the case of FIG. 5, taken in a VI-VI direction. FIG. 7 is a side view of the case of FIG. 5 which is viewed in a VII direction.

Referring to FIGS. 5 to 7, the case 110 may include an upper wall 111, a lower wall 112, a partition 113, a connection passage 114, and a side wall 115.

The case 110 may accommodate the components arranged on the upper portion of the main body (e.g., the main body 11 of FIG. 2), or the components may be located inside the upper portion of the main body. For example, the case 110 may accommodate at least one component (e.g., the electronic component 60 of FIG. 4).

The case 110 may include a first section A1 in which the electronic component is accommodated, a second section A2 in which the accommodation space 110*i*, where the aerosol generating article is accommodated, and a heater (e.g., the heater 130 of FIG. 4) are located, and a third section A3 in which a cartridge (e.g., the cartridge 200 of FIG. 4) is arranged.

In this case, because the first section A1 is region where the electronic components may be densely arranged and sealed by a sealing portion (e.g., the sealing portion 170 of FIG. 3) and a cover (e.g., the cover 100 of FIG. 3), the first section A1 may be greatly influenced by the heated air in a negative way. Therefore, the case 110 may include the vent 110*h* in a portion of the case 110 in the first section A1.

The first section A1 may be separated from the second section A2 by the sealing portion (e.g., the sealing portion 170 of FIG. 3). The first section A1 may be separated from the third section A3 by the upper wall 111. The second section A2 may be separated from the third section A3 by the partition 113.

The case 110 may include the upper wall 111. The upper wall 111 may extend in a first direction in the first section A1, and at least one electronic component 60 may be arranged on the upper portion of the upper wall 111 and thus accommodated in the upper portion of the case 110. In this case, the term 'first direction' may denote an x-axis direction. The vent 110*h* may be located in a portion of the upper wall 111.

Referring to FIG. 5, the upper wall 11I may extend only in the −x direction with respect to the partition 113. An upper section of the upper wall 111 extending in the −x direction with respect to the partition 113 may be the first section A1. A lower section of the upper wall 111 extending in the −x direction with respect to the partition 113 may be the third section A3.

The vent 110*h* may be located in a portion of the upper wall 111 located between the first section A1 and the third section A3. The vent 110*h* may be open in a second direction crossing the first direction. In this case, the term 'second section' may denote the z-axis direction.

A section in the +x direction with respect to the partition 113 may be the second section A2.

The case 110 may include the accommodation space 110*i* that is open in the second direction and extends in the second direction to accommodate the aerosol generating article (not shown) in the second section A2.

Referring to FIG. 5, the accommodation space 110*i* may be surrounded by the partition 113 and the side wall 115 of the case 110. However, one or more embodiments are not limited thereto, and the accommodation space may be surrounded by a housing (e.g., the housing 120 of FIG. 3) accommodated in the case 110.

In the second section A2, the heater may be arranged outside the aerosol generating article accommodated in the accommodation space 110*i*.

The case 110 may include the lower wall 112 facing the upper wall 111 and extending in the first direction.

Referring to FIG. 5, the lower wall 112 may extend in the +x direction and the −x direction with respect to the partition 113. The lower wall 112 may support the housing in the second section A2. The lower wall 112 may also support the cartridge in the third section A3.

The cartridge may be inserted between the upper wall 111 and the lower wall 112 and coupled to the case 110. The cartridge coupled to the case 110 may close the third section A3.

The case 110 may include the partition 113. As described above, the partition 113 may separate the second section in which the accommodation space accommodating therein the aerosol generating article is located, from the third section in which the cartridge 200 is located.

The partition 113 may face the first direction, extend in the second direction, and be arranged between the upper wall 111 and the lower wall 112.

The third section A3 of the case 110 may be open from the partition 113 in the first direction. Referring to FIG. 5, the third section A3 may be open from the partition 113 in the −x direction, but one or more embodiments are not limited thereto.

The vent 110*h* may be arranged adjacent to the partition 113 in a portion of the upper wall 111.

The case 110 may include the connection passage 114. The connection passage 114 may be arranged in a portion of the partition 113 and connect the second section A2 to the third section A3.

A portion of the transmission passage (e.g., the transmission passage 140 of FIG. 4) arranged in the second section A2 and a portion of an outlet (e.g., the outlet 240 of FIG. 4) of the cartridge arranged in the third section A3 may be inserted into the connection passage 114. Therefore, the portion of the transmission passage and the portion of the outlet may be connected to each other inside the connection passage 114, and the portion, in which the portion of the transmission passage is connected to that of the outlet, may be sealed inside the connection passage 114.

The case 110 may include the side wall 115. The side wall 115 may extend in a circumferential direction of the case 110 and form at least a portion of the exterior of the case 110.

In the third section A3, a portion of the side wall 115 may be open in the first direction. Referring to FIG. 5, a portion of the side wall 115 may be open in the −x direction. The cartridge may come close, in the +x direction, to the case 110 through the open portion of the case 115 and be coupled thereto.

In the third section A3, the side wall 115 may include a button hole through which a button (the button 150 of FIG. 2) is exposed to the outside.

The side wall 115 may surround the upper portion of the upper wall 111. That is, an upper end portion of the side wall 115 may extend in the circumferential direction and surround the upper portion of the upper wall 111. The upper end portion of the side wall 115, which surrounds the upper portion of the upper wall 111, may include a plurality of grooves. As the protrusions of the cover are inserted into the grooves, the cover may be coupled to the upper portion of the case 110.

Also, the upper end portion of the side wall 115 described above may surround and stably support the electronic components 60 arranged on the upper portion of the upper wall 111.

The first section A1 may be a section of the upper portion of the upper wall 111 extending in the −x direction with respect to the partition 113 and surrounded by the upper end portion of the side wall 115.

The second section A2 may be surrounded by the side wall 115 and the partition 113. The second section A2 is closed by the lower wall 112 in the −z direction and open in the +z direction.

The third section A3 may be surrounded by the portion of the side wall 115 and the partition 113. The third section A3 may be open in the −x direction and closed by the upper wall 111 and the lower wall 112 in the z-axis direction.

Hereinafter, 'sections and relevant components which are negatively affected by heated air' are described in detail with reference to FIGS. 8 and 9.

FIGS. 8 and 9 are diagrams for explaining sections negatively influenced by the heated air.

FIG. 8 is a perspective view showing an enlarged cross-section of an upper portion of the aerosol generating device of FIG. 1. FIG. 9 is a perspective view showing that some components of the aerosol generating device of FIG. 3 are omitted.

Referring to FIGS. 8 and 9, the aerosol generating device 1 may include the case 110, the heating element 30, the electronic components 60, the sealing portion 170, a clearance adjusting portion 180, and the cartridge 200. The reference symbols of FIG. 6 are referred to for the reference symbols that are not shown in FIGS. 8 and 9.

The heating element 30 may include a heater 130 and a vaporizer 230. The heater 130 may heat the aerosol generating material accommodated in the accommodation space 110*i* to generate an aerosol. The vaporizer 230 may receive the aerosol generating material from the storage 220 and heat the received aerosol generating material, thereby generating an aerosol.

The heater 130 may be arranged inside the housing 120 and located in the second section A2 along with the housing 120. The vaporizer 230 may be arranged inside the cartridge 200 and located in the third section A3 along with the cartridge 200.

As described above, because the first section A1 is the region in which the electronic components 60 are densely arranged and which is sealed by the sealing portion 170, the cover 100, and the like, the first section A1 may be greatly affected by the heated air in a negative way.

Referring to FIG. 5, because the first section A1 is closer to the heater 130 in the second section A2 than to the vaporizer 230 in the third section A3, the air in the first section A1 may be mainly heated by the heater 130. However, the arrangements of the heater 130 and the vaporizer 230 are not limited to the description above, and the reasons why the air in the aerosol generating device 1 is heated may vary according to embodiments.

The electronic components 60 arranged in the first section A1 may include an optical sensor 160 and a circuit board 161 for an optical sensor.

The optical sensor 160 may include an optical element that transmits light reflected from the aerosol generating article inserted into the accommodation space 110*i* in the second section A2, and a sensing unit for sensing light.

For example, the optical sensor 160 may be a color sensor for sensing a color of the aerosol generating article and preventing reuse of the aerosol generating article. Also, the optical sensor 160 may be a proximity sensor for sensing the insertion of the aerosol generating article into the accommodation space 110*i* in the second section A2.

The optical sensor 160 may be arranged on an upper surface of the upper wall 111 together with the circuit board 161 for an optical sensor.

The vent 110*h* may be arranged in the upper wall 111 to prevent the optical element from fogging and may be open towards the optical sensor 160.

Referring to FIGS. 8 and 9, the vent 110*h* in the upper wall 111 may be located under the optical sensor 160, but one or more embodiments are not limited to the location of the vent 110*h*.

As the heated air is not accumulated in an upper space of the upper wall 111 and moves through the vent 110*h*, the fogging on the optical element may be prevented.

The electronic components 60 arranged in the first section A1 may include a puff sensor 165 and a circuit board 166 for a puff sensor. The puff sensor 165 may detect a change in pressure of an airflow passage, which occurs according to puffs of a user.

The puff sensor 165 may be arranged on the upper surface of the upper wall 111 together with the circuit board 166 for a puff sensor.

The upper wall 111 may include a puff hole 111*p* that is open towards the puff sensor 165 so that the air may flow into the puff sensor 165. The puff hole 111*p* in the upper wall 111 may be located above an air inflow passage 200*i* extending in the z-axis direction.

The sealing portion 170 may cover at least a portion of the case 110 in the first section A1 and separate the first section A1 from the second section A2. Referring to FIG. 8, with respect to a surface of the sealing portion 170 in the x-axis direction, a section in the +x direction may be the second section A2, whereas a section in the −x direction may be the first section A1.

The sealing portion 170 may cover the electronic components 60 arranged on the upper portion of the case 110 while covering the case 110.

The sealing portion 170 may cover the optical sensor 160 and cover a portion between the aerosol generating article inserted in the accommodation space 110*i* in the x-axis direction and the optical sensor 160. In this regard, the sealing portion 170 may include a transparent or translucent material through which light may pass. As such, the optical sensor 160 may sense light reflected from the aerosol generating article and passing through the sealing portion 170.

The vent 110*h* may be open in a direction towards the sealing portion 170 from the case 110. Referring to FIG. 8, the vent 110*h* in the upper wall 111 may be open in the z-axis direction that is the direction towards the sealing portion 170 from the case 110.

The clearance adjusting portion 180 may be arranged between the case 110 and the electronic component 60. The clearance adjusting portion 180 may contact the case 110 and the electronic component 60 and remove a clearance therebetween.

Referring to FIG. 8, the clearance adjusting portion 180 may be arranged to accommodate the puff sensor 165 and cover at least a portion of the upper surface of the upper wall 111. The clearance adjusting portion 180 may be open towards the puff hole 111*p* such that the air passing through the puff hole 111*p* may flow into the puff sensor 165.

At least a portion of the clearance adjusting portion 180 may contact the sealing portion 170. Referring to FIG. 8, the sealing portion 170 may cover the clearance adjusting portion 180 contacting the upper surface of the upper wall 111. A closed space may be formed between the sealing portion 170 and the clearance adjusting portion 180, and the electronic components 60 may be arranged in the closed space.

A portion of the clearance adjusting portion 180, which contacts the upper wall 111, may be open not to cover the vent 110*h*. The air in the closed space may pass through the open portion of the clearance adjusting portion 180 and move through the vent 110*h* located in the upper wall 111.

The air moving through the vent 110*h* needs to be discharged to the outside of the aerosol generating device 1.

When the cartridge 200 is inserted between the upper wall 111 and the lower wall 112 of the cartridge 200 and coupled to the case 110, a gap may be generated between the upper wall 111 and the cartridge 200. In this case, the gap may become a passage through which the air moves.

That is, an air discharge passage 200*e* may be formed between the upper wall 111 and the cartridge 200, and the vent 110*h* may be in fluid communication with the air discharge passage 200*e*.

Hereinafter, 'the passage through which the air moving through the vent 110*h* is discharged to the outside' is described in detail with reference to FIGS. 10 and 11.

FIGS. 10 and 11 are diagrams for explaining the passage through which air moving through a vent is discharged to the outside.

FIG. 10 is a cross-sectional view showing the flow of air inside an aerosol generating device in which an aerosol generating article is inserted, according to an embodiment. FIG. 11 is a cross-sectional view showing the flow of air that moves from the inside of the aerosol generating device, in which the aerosol generating article is inserted, to the outside thereof, according to an embodiment.

FIG. 11 shows that a cover 10 is coupled to an upper portion of the aerosol generating device 1 of FIG. 10. Although not shown in FIG. 11, other components may be arranged between the upper portion of the aerosol generating device 1 of FIG. 10 and the cover 10.

Hereinafter, the repeated descriptions are omitted, and the reference symbols of FIGS. 4 and 6 are referred to for those not shown in FIGS. 10 and 11.

The vent 110*h* may be in fluid communication with the air discharge passage 200*e*. Accordingly, a first airflow path P1 may be formed by the vent 110*h* and the air discharge passage 200*e*.

Along the first airflow path P1, the heated air in the first section A1 may pass through the air discharge passage 200*e* in the third section A3 via the vent 110*h* and be discharged to the outside of the case 110.

On the contrary, relatively cold air exiting outside the case 110 may flow into the air discharge passage 200*e* as well as the air inflow passage 200*i*. Along the first airflow path P1, the cold air may pass through the vent 110*h* via the air discharge passage 200*e* located in the third section A3 and reach the first section A1.

To sum up, through the first airflow path P1, the heated air in the first section A1 may be discharged to the outside of the case 110, and the relatively cold air outside the case 110 may flow into the first section A1. Accordingly, a temperature of the air in the first section A1 may decrease.

Separately from the first airflow path P1, a second airflow path P2 may be formed in the aerosol generating device 1, through which the aerosols generated from the cartridge 200 and the aerosol generating article 2 may be delivered to the user.

The second airflow path P2 may be an airflow path through which a mixture of a primary aerosol, which is generated as the aerosol generating material in the cartridge 200 is heated by the vaporizer 230, and a secondary aerosol, which is generated as the aerosol generating article 2 is heated by the heater 130, passes to be inhaled by the user.

Referring to FIG. 10, the second airflow path P2 starts from an entrance of the air inflow passage 200*i* of the cartridge 200.

Air outside the case 110 and the cartridge 200 may flow into the air inflow passage 200*i*. The air may move along the air inflow passage 200*i* and reach the vaporizer 230.

The air reaching the vaporizer 230 may be mixed with the primary aerosol and move to the outside the cartridge 200 by passing through the outlet 240.

The primary aerosol mixed with the air may move along the transmission passage 140 connected to the outlet 240 and may flow into an end of the aerosol generating article 2 accommodated in the accommodation space 110*i*.

While the primary aerosol mixed with the air passes through the aerosol generating article 2, the secondary aerosol may be generated from the aerosol generating article 2. Therefore, the primary aerosol mixed with the air may be mixed with the secondary aerosol while passing through the aerosol generating article 2.

The air containing both the primary aerosol and the secondary aerosol may move to a user's mouth which is a final destination of the second airflow path P2.

The second airflow path P2 may indicate a path along which the air and the aerosols move when the user puffs on the aerosol generating article 2. Referring to FIGS. 10 and 11, the second airflow path P2 provides a single route for the air flow. However, the direction in which the air and the aerosols move are not limited thereto.

The air discharge passage 200*e* may be formed in a direction crossing the air inflow passage 200*i*. In this case, an entrance of the air inflow passage 200*i* may be open towards the upper wall 111, and the air discharge passage 200*e* may be connected to the entrance of the air inflow passage 200*i*.

Accordingly, the first airflow path P1 passing the air discharge passage 200*e* and the second airflow path P2 formed along the air inflow passage 200*i* may intersect at the entrance of the air inflow passage 200*i*.

Because the first airflow path P1 and the second inflow path P2 each are an air inflow path formed inside the aerosol generating device 1, each airflow path needs to be connected to the outside of the aerosol generating device 1.

Referring to FIG. 11, a common airflow path PC may be formed outside the case 110 and the cartridge 200. The common airflow path PC may be connected to the first airflow path P1 and the second airflow path P2 and formed to the outside of the aerosol generating device 1.

Along the common airflow path PC, air outside the aerosol generating device 1 may flow into the cover 10 through a sliding groove (e.g., the sliding groove 10*g* of FIG. 1) of the cover 10. The air may pass a space between the cover 10 and other components and reach the air inflow passage 200*i* and the air discharge passage 200*e*.

Along the common airflow path PC, the air may move in the opposite direction to the above-described direction. That is, the air may move from the air inflow passage 200*i* and the air discharge passage 200*e* to the outside of the aerosol generating device 1.

However, when the user holds the aerosol generating article 2 in their mouth to inhale the air, there may be a pressure difference between the outside of the aerosol generating device 1 and the user's mouth. Because of the pressure difference, most of the air may move to the user's mouth from the outside of the aerosol generating device 1.

Referring to FIG. 11, the entrance of the air inflow passage 200*i* may be open towards the upper wall 111, and thus, the common airflow path PC may be connected to the first airflow path P1 and the second airflow path P2 at the entrance of the air inflow passage 200*i*.

However, one or more embodiments are not limited to the above-described arrangement of the entrance of the air inflow passage. For example, the entrance of the air inflow passage may be arranged in a direction crossing the side plate 210, and thus, the air inflow passage may not be connected to the air discharge passage.

In this case, the first airflow path formed along the air discharge passage may not cross the second airflow path formed along the air inflow passage, and the first airflow path and the second airflow path may each be connected to the common airflow path PC.

Also, the air outside the aerosol generating device 1 may be introduced through the portion in which the cover 10 is coupled to the main body 11 and may flow into the common airflow path PC, but it is not shown in FIG. 11.

As the first airflow path P1 and the second airflow path P2 are connected to the common airflow path PC, the air discharge passage 200*e* and the air inflow passage 200*i* may be in fluid communication with the outside of the aerosol generating device 1.

Through the second airflow path P2 and the common airflow path PC, the air and/or the aerosol may move from the outside of the aerosol generating device 1 to the user's mouth.

Through the first airflow path P1 and the common airflow path PC, the heated air in the first section A1 may be discharged to the outside of the aerosol generating device 1, and the relatively cold air outside the aerosol generating device 1 may flow into the first section A1. Accordingly, the temperature of the air in the first section A1 may decrease.

Because the vent 110*h* provides fluid communication between the first section A1 and the air discharge passage 200*e*, the first section A1 may be in fluid communication with the outside of the aerosol generating device 1 through the vent 110*h*. That is, the arrangement of the vent 110*h* may decrease 'the negative influence of the heated air' by preventing 'the deformation of the components by the heated air.'

FIG. 12 is a block diagram of an aerosol generating device 1200 according to an embodiment.

The aerosol generating device 1200 may include a controller 1210, a sensing unit 1220, an output unit 1230, a battery 1240, a heater 1250, a user input unit 1260, a memory 1270, and a communication unit 1280. However, the internal structure of the aerosol generating device 1200 is not limited to those illustrated in FIG. 12. That is, according to the design of the aerosol generating device 1200, it will be understood by one of ordinary skill in the art that some of the components shown in FIG. 12 may be omitted or new components may be added.

The sensing unit 1220 may sense a state of the aerosol generating device 1200 and a state around the aerosol generating device 1200, and transmit sensed information to the controller 1210. Based on the sensed information, the controller 1210 may control the aerosol generating device 1200 to perform various functions, such as controlling an operation of the heater 1250, limiting smoking, determining whether an aerosol generating article (e.g., a cigarette, a cartridge, or the like) is inserted, displaying a notification, or the like.

The sensing unit 1220 may include at least one of a temperature sensor 1222, an insertion detection sensor, and a puff sensor 1226, but is not limited thereto.

The temperature sensor 1222 may sense a temperature at which the heater 1250 (or an aerosol generating material) is heated. The aerosol generating device 1200 may include a separate temperature sensor for sensing the temperature of the heater 1250, or the heater 1250 may serve as a temperature sensor. Alternatively, the temperature sensor 1222 may also be arranged around the battery 1240 to monitor the temperature of the battery 1240.

The insertion detection sensor 1224 may sense insertion and/or removal of an aerosol generating article. For example, the insertion detection sensor 1224 may include at least one of a film sensor, a pressure sensor, an optical sensor, a resistive sensor, a capacitive sensor, an inductive sensor, and an infrared sensor, and may sense a signal change according to the insertion and/or removal of an aerosol generating article.

The puff sensor 1226 may sense a user's puff on the basis of various physical changes in an airflow passage or an airflow channel. For example, the puff sensor 1226 may sense a user's puff on the basis of any one of a temperature change, a flow change, a voltage change, and a pressure change.

The sensing unit 1220 may include, in addition to the temperature sensor 1222, the insertion detection sensor 1224, and the puff sensor 1226 described above, at least one of a temperature/humidity sensor, a barometric pressure sensor, a magnetic sensor, an acceleration sensor, a gyroscope sensor, a location sensor (e.g., a global positioning system (GPS)), a proximity sensor, and a red-green-blue (RGB) sensor (illuminance sensor). Because a function of each of sensors may be intuitively inferred by one of ordinary skill in the art from the name of the sensor, a detailed description thereof may be omitted.

The output unit 1230 may output information on a state of the aerosol generating device 1200 and provide the information to a user. The output unit 1230 may include at least one of a display unit 1232, a haptic unit 1234, and a sound output unit 1236, but is not limited thereto. When the display unit 1232 and a touch pad form a layered structure to form a touch screen, the display unit 1232 may also be used as an input device in addition to an output device.

The display unit 1232 may visually provide information about the aerosol generating device 1200 to the user. For example, information about the aerosol generating device 1200 may mean various pieces of information, such as a charging/discharging state of the battery 1240 of the aerosol generating device 1200, a preheating state of the heater 1250, an insertion/removal state of an aerosol generating article, or a state in which the use of the aerosol generating device 1200 is restricted (e.g., sensing of an abnormal object), or the like, and the display unit 1232 may output the information to the outside. The display unit 1232 may be, for example, a liquid crystal display panel (LCD), an organic light-emitting diode (OLED) display panel, or the like. In addition, the display unit 1232 may be in the form of a light-emitting diode (LED) light-emitting device.

The haptic unit 1234 may tactilely provide information about the aerosol generating device 1200 to the user by converting an electrical signal into a mechanical stimulus or an electrical stimulus. For example, the haptic unit 1234 may include a motor, a piezo-electric element, or an electrical stimulation device.

The sound output unit 1236 may audibly provide information about the aerosol generating device 1200 to the user. For example, the sound output unit 1236 may convert an electrical signal into a sound signal and output the same to the outside.

The battery 1240 may supply power used to operate the aerosol generating device 1200. The battery 1240 may supply power such that the heater 1250 may be heated. In addition, the battery 1240 may supply power required for operations of other components (e.g., the sensing unit 1220, the output unit 1230, the user input unit 1260, the memory 1270, and the communication unit 1280) in the aerosol generating device 1200. The battery 1240 may be a rechargeable battery or a disposable battery. For example, the battery 1240 may be a lithium polymer (LiPoly) battery, but is not limited thereto.

The heater 1250 may receive power from the battery 1240 to heat an aerosol generating material. Although not illustrated in FIG. 12, the aerosol generating device 1200 may further include a power conversion circuit (e.g., a direct current (DC)/DC converter) that converts power of the battery 1240 and supplies the same to the heater 1250. In addition, when the aerosol generating device 1200 generates aerosols in an induction heating method, the aerosol generating device 1200 may further include a DC/alternating current (AC) that converts DC power of the battery 1240 into AC power.

The controller 1210, the sensing unit 1220, the output unit 1230, the user input unit 1260, the memory 1270, and the communication unit 1280 may each receive power from the battery 1240 to perform a function. Although not illustrated in FIG. 12, the aerosol generating device 1200 may further include a power conversion circuit that converts power of the battery 1240 to supply the power to respective components, for example, a low dropout (LDO) circuit, or a voltage regulator circuit.

In an embodiment, the heater 1250 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, nichrome, or the like, but is not limited thereto. In addition, the heater 1250 may be implemented by a metal wire, a metal plate on which an electrically conductive track is arranged, a ceramic heating element, or the like, but is not limited thereto.

In another embodiment, the heater 1250 may be a heater of an induction heating type. For example, the heater 1250 may include a suspector that heats an aerosol generating material by generating heat through a magnetic field applied by a coil.

The user input unit 1260 may receive information input from the user or may output information to the user. For example, the user input unit 1260 may include a key pad, a dome switch, a touch pad (a contact capacitive method, a pressure resistance film method, an infrared sensing method, a surface ultrasonic conduction method, an integral tension measurement method, a piezo effect method, or the like), a jog wheel, a jog switch, or the like, but is not limited thereto. In addition, although not illustrated in FIG. 12, the aerosol generating device 1200 may further include a connection interface, such as a universal serial bus (USB) interface, and may connect to other external devices through the connection interface, such as the USB interface, to transmit and receive information, or to charge the battery 1240.

The memory 1270 is a hardware component that stores various types of data processed in the aerosol generating device 1200, and may store data processed and data to be processed by the controller 1210. The memory 1270 may include at least one type of storage medium from among a flash memory type, a hard disk type, a multimedia card micro type memory, a card-type memory (for example, secure digital (SD) or extreme digital (XD) memory, etc.), random access memory (RAM), static random access memory (SRAM), read-only memory (ROM), electrically erasable programmable read-only memory (EEPROM), programmable read-only memory (PROM), a magnetic memory, a magnetic disk, and an optical disk. The memory 1270 may store an operation time of the aerosol generating device 1200, the maximum number of puffs, the current number of puffs, at least one temperature profile, data on a user's smoking pattern, etc.

The communication unit 1280 may include at least one component for communication with another electronic device. For example, the communication unit 1280 may include a short-range wireless communication unit 1282 and a wireless communication unit 1284.

The short-range wireless communication unit 1282 may include a Bluetooth communication unit, a Bluetooth Low Energy (BLE) communication unit, a near field communication unit, a wireless LAN (WLAN) (Wi-Fi) communication unit, a Zigbee communication unit, an infrared data association (IrDA) communication unit, a Wi-Fi Direct (WFD) communication unit, an ultra-wideband (UWB) communication unit, an Ant+ communication unit, or the like, but is not limited thereto.

The wireless communication unit 1284 may include a cellular network communication unit, an Internet communication unit, a computer network (e.g., local area network (LAN) or wide area network (WAN)) communication unit, or the like, but is not limited thereto. The wireless communication unit 1284 may also identify and authenticate the aerosol generating device 1200 within a communication network by using subscriber information (e.g., International Mobile Subscriber Identifier (IMSI)).

The controller 1210 may control general operations of the aerosol generating device 1200. In an embodiment, the controller 1210 may include at least one processor. The processor may be implemented as an array of a plurality of logic gates or may be implemented as a combination of a general-purpose microprocessor and a memory in which a program executable by the microprocessor is stored. It will be understood by one of ordinary skill in the art that the processor may be implemented in other forms of hardware.

The controller 1210 may control the temperature of the heater 1250 by controlling supply of power of the battery 1240 to the heater 1250. For example, the controller 1210 may control power supply by controlling switching of a switching element between the battery 1240 and the heater 1250. In another example, a direct heating circuit may also control power supply to the heater 1250 according to a control command of the controller 1210.

The controller 1210 may analyze a result sensed by the sensing unit 1220 and control subsequent processes to be performed. For example, the controller 1210 may control power supplied to the heater 1250 to start or end an operation of the heater 1250 on the basis of a result sensed by the sensing unit 1220. As another example, the controller 1210 may control, based on a result sensed by the sensing unit 1220, an amount of power supplied to the heater 1250 and the time the power is supplied, such that the heater 1250 may be heated to a certain temperature or maintained at an appropriate temperature.

The controller 1210 may control the output unit 1230 on the basis of a result sensed by the sensing unit 1220. For example, when the number of puffs counted through the puff sensor 1226 reaches a preset number, the controller 1210 may notify the user that the aerosol generating device 1200 will soon be terminated through at least one of the display unit 1232, the haptic unit 1234, and the sound output unit 1236.

One embodiment may also be implemented in the form of a computer-readable recording medium including instructions executable by a computer, such as a program module executable by the computer. The computer-readable recording medium may be any available medium that may be accessed by a computer and includes both volatile and nonvolatile media, and removable and non-removable media. In addition, the computer-readable recording medium may include both a computer storage medium and a communication medium. The computer storage medium includes all of volatile and nonvolatile media, and removable and non-removable media implemented by any method or technology for storage of information such as computer-readable instructions, data structures, program modules, or other data. The communication medium typically includes computer-readable instructions, data structures, other data in modulated data signals such as program modules, or other transmission mechanisms, and includes any information transfer media.

The descriptions of the above-described embodiments are merely examples, and it will be understood by one of ordinary skill in the art that various changes and equivalents thereof may be made. Therefore, the scope of the disclosure should be defined by the appended claims, and all differences within the scope equivalent to those described in the claims will be construed as being included in the scope of protection defined by the claims.

The invention claimed is:

1. An aerosol generating device comprising:

a case comprising an accommodation space to accommodate an aerosol generating article and configured to accommodate at least one electronic component;

a heater arranged in the accommodation space and configured to heat the aerosol generating article accommodated in the accommodation space; and a cartridge detachably coupled to the case and comprising a storage configured to store an aerosol generating material, and a vaporizer configured to receive and heat the aerosol generating material, wherein the case comprises a vent formed between the accommodation space and the cartridge, and configured to be through which air heated by the heat generated from the heater or the vaporizer passes, wherein the case further comprises a first section in which the electronic component is accommodated, a second section comprising the accommodation space, a third section in which the cartridge is arranged, and an upper wall separating the first section from the third section, and wherein the vent is arranged in the upper wall between the first section and the third section.

2. The aerosol generating device of claim 1, further comprising a sealing portion separating the first section from the second section and covering at least a portion of the case and the electronic component in the first section, wherein the vent is open in a direction towards the sealing portion from the case.

3. The aerosol generating device of claim 1, wherein the case further comprises a partition separating the second section from the third section, and the vent is arranged adjacent to the partition.

4. The aerosol generating device of claim 1, wherein the upper wall extends in a first direction in the first section and configured to accommodate the electronic component in an upper portion of the case.

5. The aerosol generating device of claim 4, wherein the accommodation space is open in a second direction crossing the first direction to accommodate the aerosol generating article in the second section, and extends in the second direction.

6. The aerosol generating device of claim 4, wherein the vent is open in a second direction crossing the first direction.

7. The aerosol generating device of claim 4, wherein the electronic component is arranged on an upper surface of the upper wall and comprises an optical sensor comprising an optical element configured to transmit light reflected from the aerosol generating article accommodated in the second section, and a sensing unit configured to sense the light, and the vent is open towards the optical sensor to prevent the optical element from fogging.

8. The aerosol generating device of claim 4, wherein the case further comprises a lower wall facing the upper wall and extending in the first direction, and the cartridge is inserted between the upper wall and the lower wall and closes the third section.

9. The aerosol generating device of claim 4, wherein an air discharge passage is formed between the upper wall and the cartridge as the cartridge is coupled to the case.

10. The aerosol generating device of claim 9, wherein the vent is in fluid connection with the air discharge passage, and a first airflow path passing the vent and the air discharge passage is formed.

11. The aerosol generating device of claim 10, wherein the cartridge further comprises an air inflow passage configured to deliver air to the vaporizer, the air discharge passage is formed in a direction crossing the air inflow passage, and the first airflow path intersects with a second airflow path formed along the air inflow passage at an entrance of the air inflow passage.

12. The aerosol generating device of claim 11, wherein the second airflow path comprises an airflow path through which a mixture of a primary aerosol and a secondary aerosol passes to be inhaled by a user, wherein the primary aerosol is generated as the aerosol generating material is heated by the vaporizer, and the secondary aerosol is generated as the aerosol generating article is heated by the heater.

13. The aerosol generating device of claim 11, wherein the first airflow path and the second airflow path are connected to a common airflow path formed outside the case and the cartridge, and the air discharge passage and the air inflow passage are in fluid connection with an outside of the aerosol generating device through the common airflow path.

* * * * *